US007395990B1

(12) United States Patent
Stevens

(10) Patent No.: US 7,395,990 B1
(45) Date of Patent: Jul. 8, 2008

(54) SELF-BAGGING GARBAGE CAN SYSTEM

(76) Inventor: Geoffrey Stevens, 11 Beach La., Lakewood, WA (US) 98498

( * ) Notice: Subject to any disclaimer, the term of this patent is extended or adjusted under 35 U.S.C. 154(b) by 0 days.

(21) Appl. No.: 11/707,836

(22) Filed: Feb. 16, 2007

(51) Int. Cl.
*A63B 55/04* (2006.01)
*B65D 25/14* (2006.01)

(52) U.S. Cl. ..... 248/97; 248/907; 220/495.07

(58) Field of Classification Search ..... 248/95, 248/97–99, 907, 914; 220/908, 495.07, 263–264; 362/154, 276, 84; 100/226, 246, 247, 283
See application file for complete search history.

(56) References Cited

U.S. PATENT DOCUMENTS 3,800,503 A * 4/1974 Maki ..... 220/495.07
4,056,053 A 11/1977 Akerberg
4,493,251 A 1/1985 Green
4,850,507 A * 7/1989 Lemongelli et al. .... 220/495.07
5,295,607 A * 3/1994 Chang ..... 220/263
5,405,041 A * 4/1995 Van Brackle ..... 220/908
5,503,292 A * 4/1996 Cuccharia ..... 220/908
5,678,723 A * 10/1997 Swift et al. ..... 220/908
5,881,900 A * 3/1999 Meshorer ..... 220/495.07
6,126,031 A * 10/2000 Reason ..... 220/495.07
6,851,357 B1 2/2005 Martorella et al.
6,920,994 B2 7/2005 Lin
7,003,843 B1 2/2006 Moore
7,033,039 B2 4/2006 Lin
7,237,480 B2 * 7/2007 Ruddock ..... 100/226
2005/0205579 A1 * 9/2005 Buchalter et al. ..... 220/495.11

* cited by examiner

*Primary Examiner*—Amy J Sterling
*Assistant Examiner*—Tan Le
(74) *Attorney, Agent, or Firm*—Lawrence J. Gibney, Jr.

(57) ABSTRACT

In order to make it easier to use a garbage can, a self-bagging mechanism is placed in the bottom of the garbage can with an opening provided for a plurality of bags to be placed within a housing. The empty bags will be taken from the housing and will provide garbage bags to the trash cans at all times. The bag holder is designed to be refillable.

4 Claims, 6 Drawing Sheets

SELF-BAGGING GARBAGE CAN SYSTEM

BACKGROUND OF THE INVENTION

A. Field of the Invention

This relates to the common household garbage can but has a housing on the bottom of the garbage can to make the garbage can self bagging.

B. Prior Art

There are many prior art references to garbage cans in general and trash storage apparatuses. A representative example of this type of device can be found at Lin, U.S. Pat. No. 7,033,039, as well as a standard garbage can that is found in virtually every home or business. This, however, incorporates the use of a self-bagging mechanism, which will rest on the bottom of the garbage can by which an individual does not have to worry about gathering a replacement bag during the re-bagging process.

BRIEF SUMMARY OF THE INVENTION

This garbage can uses a regular household garbage can and adds an automatic self-bagging system to the base of the garbage can. The self-bagging system will be comprised of a container in which a plurality of bags will be housed. The bag holder will rest on the bottom of the shell of the garbage can and an opening on the top of the bag holder will be provided. A corresponding opening on the bottom of the garbage can is provided to allow a bag to travel from the bag holder into the garbage can.

A plurality of garbage bags will be encased in the bag holder and the holder is designed to be refillable. The bag holder will attach to the garbage can with a twist-and-snap means and the housing for the bags is designed to be refillable by opening the bottom of the housing.

In operation the bag holder is installed on the bottom of the garbage can and the first bag is placed around the opening around the top perimeter of the garbage can. When that first bag is filled up with garbage, the person will remove the full bag and an empty bag from the holder is pulled through the opening in the bag holder. The bags in the bag holder will likely be connected to each other using a row of perforations between the bags to connect the bags to each other. This connection means will allow the empty bag to be pulled through the opening and provide the user of the device an easy means to supply a bag for the garbage can.

In order to insure that only one empty bag is pulled through the opening of the bag holder a foot pedal is installed on the top of the bag holder on the outside of the device, which will allow the user to hold the remaining bags in place in the bag holder while emptying the garbage in the can. This will prevent the possibility of multiple bags passing through the opening into the garbage can.

The garbage can would be equipped with a lid, which can be found on a great number of garbage cans. However, in this lid an air freshener pouch will be installed on the underside of the lid. The air freshener will help with the inevitable odor problem that is generated by garbage. The air freshener pouch is designed to store a replacement air freshener when that becomes necessary.

Under the lid but above the level of the garbage bag will be a plastic plate, which is a flat planar member. This plate is operated by a handle on the outside of the can. The handle will allow the flat planar member to move in an up and down fashion and will allow some of the garbage to be compacted into the bag. The advantage to using the compaction device is to prevent the handling of the garbage in the can. While the lid is not a compactor per se, it does compact some of the garbage so that the person does not need to physically touch the garbage during the process of emptying the bag in the garbage can.

DETAILED DESCRIPTION OF THE EMBODIMENTS

Figure 1:
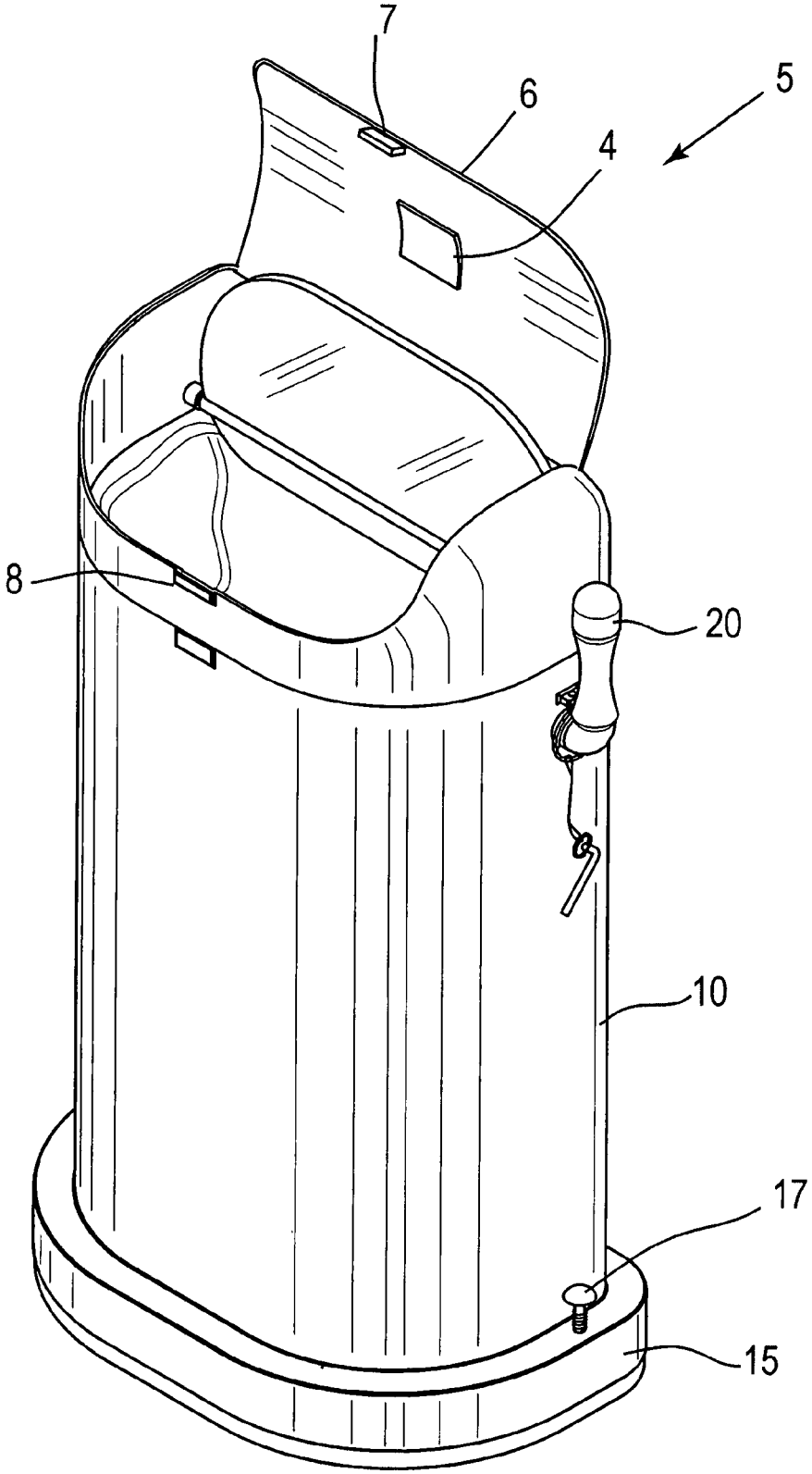
FIG. 1 is an isometric view of the garbage can with the self bagging housing on the bottom.
Figure 2:
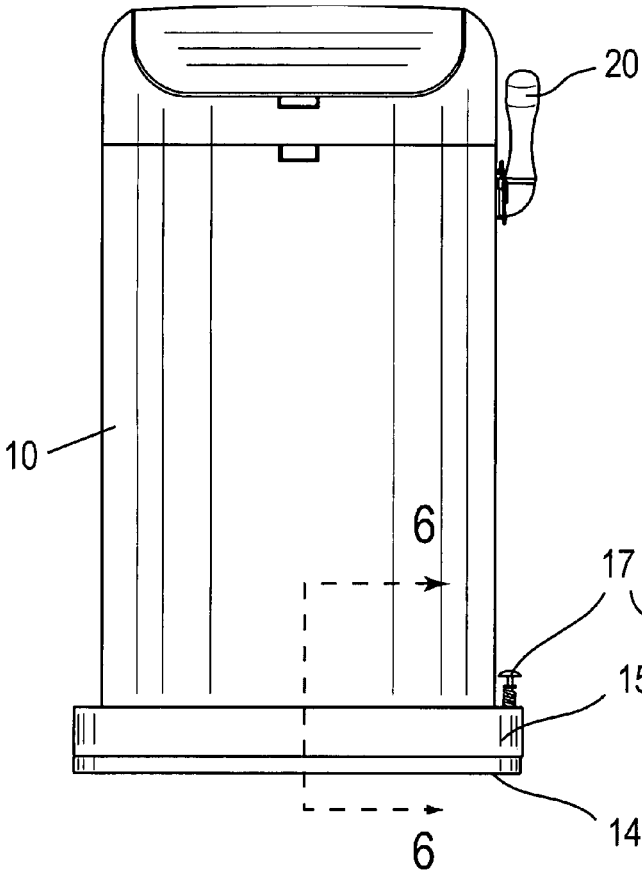
FIG. 2 is a front view of the device.
Figure 3:
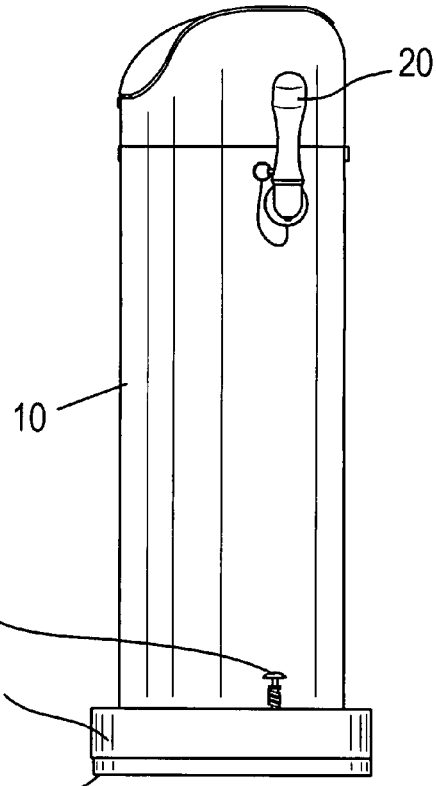
FIG. 3 is a side view of the device.

This device 5 is a garbage can with a self-bagging housing 15 on the bottom of the garbage can 10. The garbage can has an exterior shell with defined sides and a bottom and an open top as well as a lid 11. A lid cover 6, which is connected to a lid 11 will snap closed, using a male-and-female snap assembly mechanism 7, 8 on the front edge of the lid cover 6. Other means to close the cover may also be used.

A handle 20 on the exterior of the garbage can will operate a plate 9, which is a flat planar member and roughly the same shape as the inside of the garbage can to partially compact some of the garbage in the can. This is accomplished by the individual using the handle 20 on the side. The handle 20 is connected to an arcuate member 22 that when rotated will move the plate. A pin 21 to lock the handle in an upright position is also provided.

When the plate 9 rotates downward one surface of the plate will press against the top of the garbage in the bag. While the plate is not a compactor per se, it does compact the garbage in the bag sufficiently so that the person does not need to physically handle the garbage. A standard garbage bag 16 will be used with this device.

Figure 6:
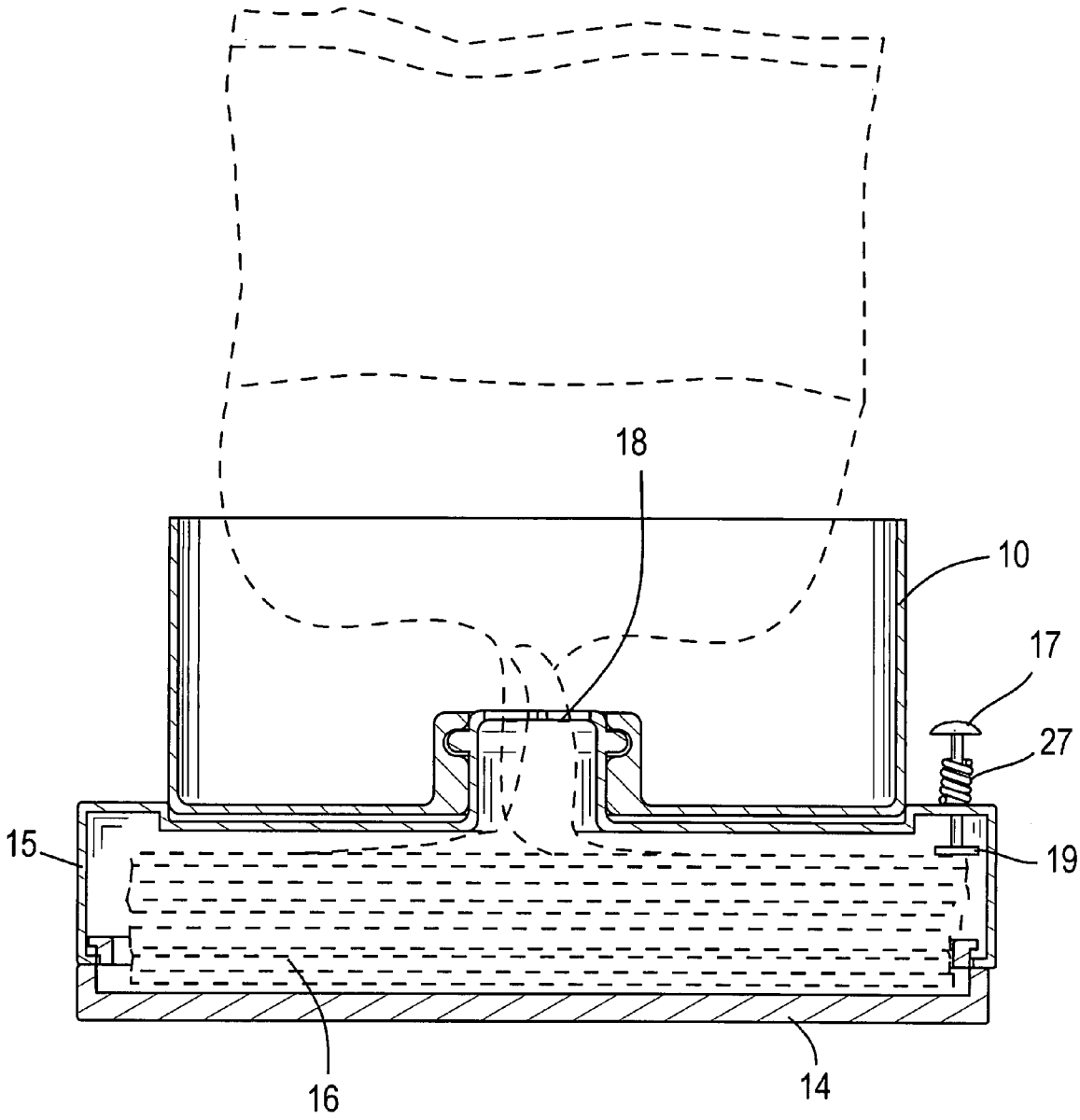
FIG. 6 is a view according to line 6-6 in FIG. 2.
Figure 7:
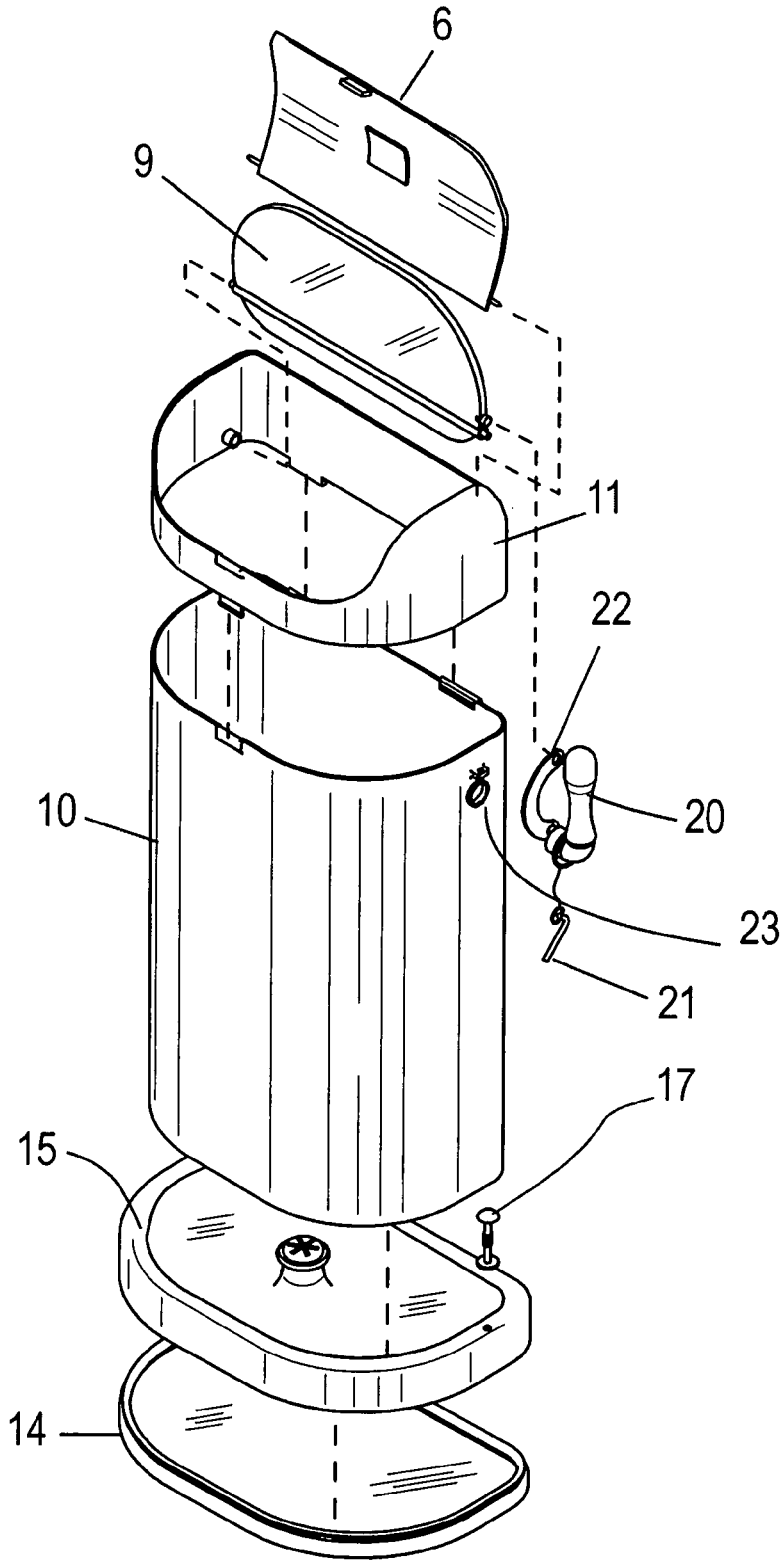
FIG. 7 is an isometric exploded view of the device.

On the bottom of the shell of the garbage can will be a bag holder 15 whereby multiple garbage bags 16 will be stored. The bag holder will contain a plurality of garbage bags and the bag holder 15 will be located below the bottom of the garbage can. On the bottom of the garbage can will be an opening 18 and likewise an opening in the bag holder; the respective openings will mate with each other as depicted in FIG. 6. The two openings will align so that an empty bag 16 may pass from the bag holder 15 to the interior of the garbage can. The bag holder 15 with the plurality of bags will be connected to the underside of the shell of the casing, probably using snaps or some other commonly used connection mechanism.

The bag holder 15 will rest on a base 14. The base 14 will connect to the bag holder 15 probably by a snap mechanism although no specific means is being claimed; the base will be detachable in order to easily fill the bag holder 15.

Figure 4:
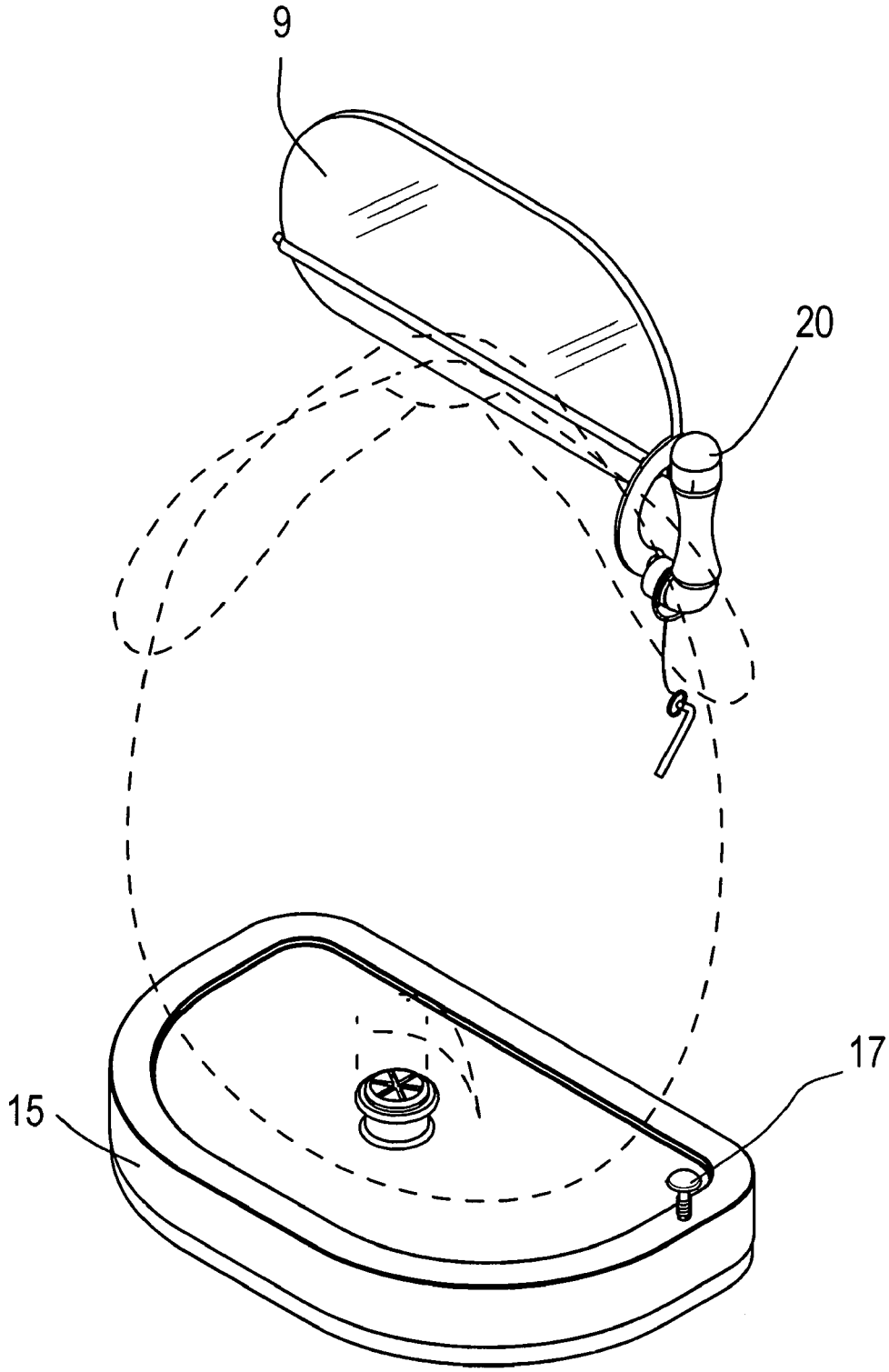
FIG. 4 is an open view of the bagger with the bag indicated by dashed lines.
Figure 5:
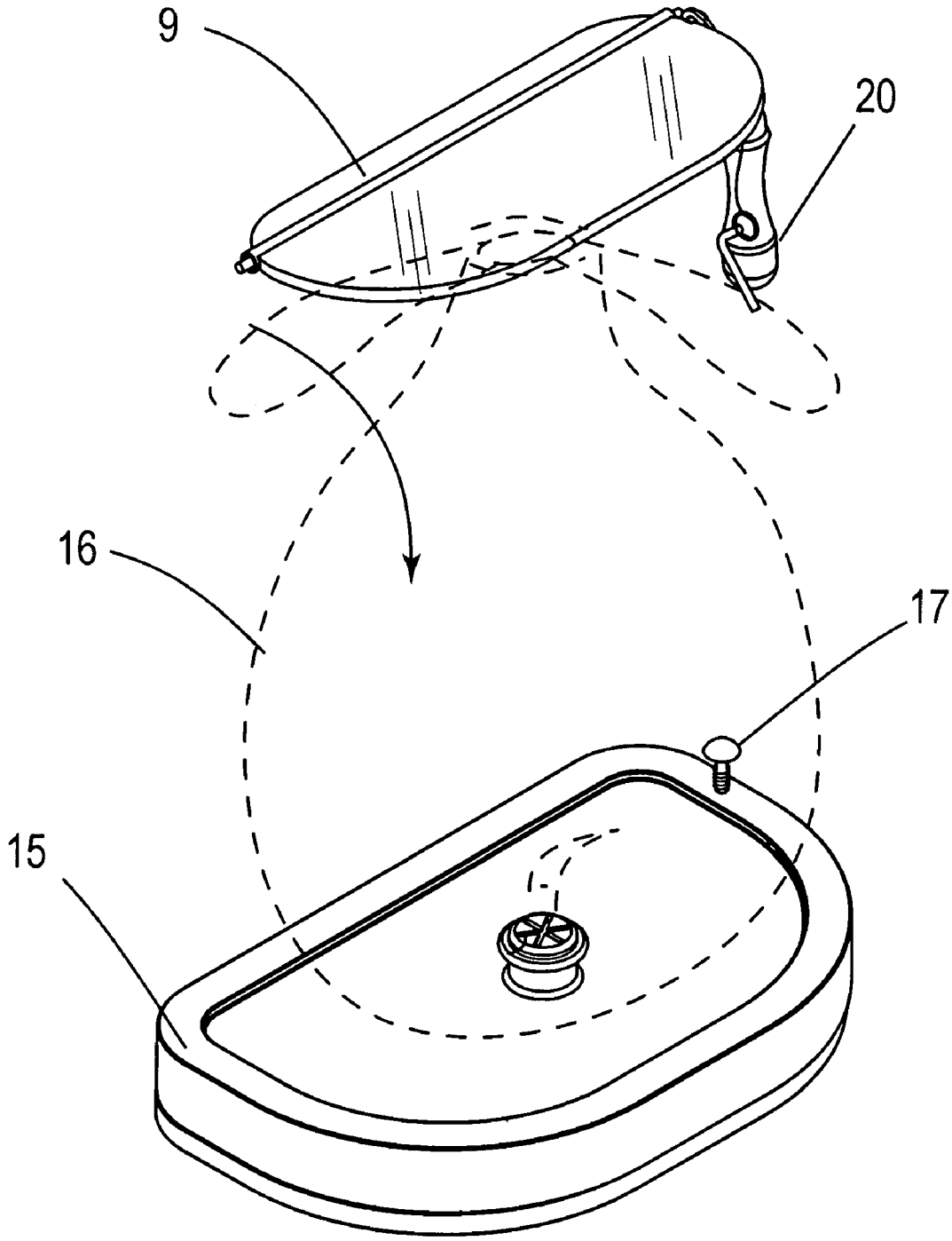
FIG. 5 is a view of the bagger with the compactor moving downward.

A bag is initially pulled out of the bag holder 15 and placed under the lid as depicted in FIG. 4. When the bag is full, the bag is tied and pulled out of the garbage can. The next garbage bag from the holder is attached to the bag in the garbage can and passes through the opening 18 on the bag holder. The means of connection between the bags in the bag holder may include a row of perforations between the bags so that when the full bag is pulled out of the garbage can the empty bag will be pulled through the opening. The row of perforations will allow the two bags to be torn from each other.

In order to protect against multiple bags passing through the opening 18 a foot pedal 17 has been installed on the side of the outside of the bag holder. The foot pedal 17 consists of an area on the outside that can be pushed downward by the user of the device and a flanged portion 19 makes direct contact with the top bag in the bag holder. Depression of the foot pedal 17 prevents multiple bags from exiting the bag holder. A spring 21 is provided to insure that the foot pedal in its normal position does not rest against the top bag in the bag holder.

The device will also use a compactor 9, which is a flat planar member, which will be operated by the handle 20. The flat planar member will compact some of the garbage in the bag when the handle is rotated in a downward fashion.

A cover 11, which is found on many garbage cans is also provided so that when the lid cover 6 is closed the garbage is not visible. On the underside of the lid cover 6 an air purifier pocket 4 will be provided. The air purifier pocket 4 is designed to house an air freshener to help ameliorate the inevitable smell of old garbage. The air purifier pocket is designed so that the consumer can replace the air purifier.

The device will be made of standard garbage can materials, and plastic is probably an excellent choice of material for all the parts. Other materials for the construction of this device are certainly not eliminated.

The invention claimed is:

1. A self-bagging mechanism for a garbage can, which is comprised of:

a. a garbage can;

said garbage can has a predetermined height, width, and length;

wherein the garbage can has an exterior shell;

wherein the garbage can has a defined bottom as well as an open top;

wherein an opening in the bottom of the garbage can is provided;

wherein a lid for the garbage can is provided;

wherein a lid cover for the garbage can is provided;

b. a bag holder;

wherein the bag holder is placed on the bottom of a garbage can housing;

said bag holder is connected to the bottom of the garbage can;

wherein a plurality of garbage bags are placed within the holder;

said bags in the holder are connected together at predetermined locations;

wherein an opening in the top of the garbage bag holder allows a bag to be retrieved from the housing;

said opening in the top of the bag holder mates with an opening in the bottom of the garbage can;

wherein a base on the bottom of the bag holder is provided;

c. foot pedal;

wherein the foot pedal is provided on the outside of the garbage bag holder;

wherein the foot pedal has a flanged member that contacts the top garbage bag in the holder;

wherein the foot pedal is held in position by a spring;

d. a handle;

wherein the handle operates a compactor;

e. compactor;

said compactor is a flat planar member which fits the opening of the garbage can;

said compactor is attached to the handle;

f. lid;

wherein a lid is provided;

wherein the lid is secured to a garbage can casing;

g. lid cover;

wherein the lid cover is provided;

said lid cover hides the contents of the garbage can;

wherein an air freshener pocket is provided on the underside of the lid cover;

f. air freshener pocket;

wherein the air freshener pocket is provided on the underside of the lid cover;

wherein the air freshener pocket is refillable.

2. The device as described in claim 1 wherein a plurality of bags is placed in the bag holder.

3. The device as described in claim 1 wherein the bag holder can be refilled.

4. The device as described in claim 1 wherein a base of the bag holder is detachable from the bag holder.

* * * * *